US008382325B2

(12) United States Patent
Hisayasu

(10) Patent No.: US 8,382,325 B2
(45) Date of Patent: Feb. 26, 2013

(54) LAMP AND LIGHTING EQUIPMENT USING THE SAME

(75) Inventor: Takeshi Hisayasu, Yokosuka-shi (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 400 days.

(21) Appl. No.: 12/825,650

(22) Filed: Jun. 29, 2010

(65) Prior Publication Data

US 2010/0327746 A1 Dec. 30, 2010

(30) Foreign Application Priority Data

Jun. 30, 2009 (JP) ..... 2009-155895

(51) Int. Cl.
*F21V 29/00* (2006.01)
*F21V 15/00* (2006.01)

(52) U.S. Cl. ..... 362/249.02; 362/294; 362/373; 362/650

(58) Field of Classification Search ..... 362/249.02–249.06, 294, 373, 230, 231, 311.02, 649–651, 362/800; 313/318.01, 318.12
See application file for complete search history.

(56) References Cited

U.S. PATENT DOCUMENTS

| | | | |
|---|---|---|---|
| 1,972,790 | A | 9/1934 | Olley |
| 4,355,853 | A | 10/1982 | Kourimsky |
| 4,503,360 | A | 3/1985 | Bedel |
| 4,630,182 | A | 12/1986 | Moroi |
| 4,939,420 | A | 7/1990 | Lim |
| 5,323,271 | A | 6/1994 | Shimada |
| 5,327,332 | A | 7/1994 | Hafemeister |
| D356,107 | S | 3/1995 | Watanabe et al. |
| 5,537,301 | A | 7/1996 | Martich |
| 5,556,584 | A | 9/1996 | Yamazaki |
| 5,585,697 | A | 12/1996 | Cote |
| 5,607,228 | A | 3/1997 | Ozaki et al. |
| 5,632,551 | A | 5/1997 | Roney |

(Continued)

FOREIGN PATENT DOCUMENTS

| | | |
|---|---|---|
| CN | 1264152 | 8/2000 |
| CN | 101307887 | 11/2008 |

(Continued)

OTHER PUBLICATIONS

English Language Abstract of JP 2008-277561 published on Nov. 13, 2008.

(Continued)

*Primary Examiner* — Bao Q Truong
(74) *Attorney, Agent, or Firm* — DLA Piper LLP (US)

(57) ABSTRACT

In one embodiment, a lamp with a ferrule includes a substrate to support a light emitting element and a wire insertion portion formed therein. A support portion to arrange the substrate is formed in one end portion of a base body. A through-hole is formed in the support portion corresponding to the wire insertion portion. A concave container portion is provided in the other end portion of the base body to accommodate a circuit board to mount electric parts. An insulating case is arranged between the circuit board and the concave container portion. The insulating case includes a protection element inserted in the through-hole and the wire insertion portion. The protection element is projected at least to inside of the wire insertion portion. A ferrule for supplying electric power to the light emitting element is provided in the other end portion of the base body.

17 Claims, 6 Drawing Sheets

U.S. PATENT DOCUMENTS 5,685,628 A 11/1997 Feger et al.
5,775,792 A 7/1998 Wiese
5,785,418 A 7/1998 Hochstein
5,857,767 A 1/1999 Hochstein
5,947,588 A 9/1999 Huang
6,095,668 A 8/2000 Rykowski et al.
6,111,359 A * 8/2000 Work et al. ..... 315/56
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 7/2003 Lodhie
6,641,283 B1 11/2003 Bohler
6,787,999 B2 9/2004 Stimac et al.
D497,439 S 10/2004 Shaw et al.
6,814,470 B2 11/2004 Rizkin et al.
6,936,855 B1 8/2005 Harrah
6,948,829 B2 * 9/2005 Verdes et al. ..... 362/227
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,165,866 B2 1/2007 Li
7,198,387 B1 4/2007 Gloisten et al.
7,226,189 B2 * 6/2007 Lee et al. ..... 362/294
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,625,104 B2 12/2009 Zhang et al.
7,631,987 B2 12/2009 Wei
7,679,096 B1 3/2010 Ruffin
7,744,256 B2 6/2010 Smester
7,824,075 B2 11/2010 Maxik
7,918,587 B2 * 4/2011 Hsu et al. ..... 362/294
7,919,339 B2 4/2011 Hsu
7,947,596 B2 5/2011 Takeda
7,963,686 B2 6/2011 Hu
8,058,782 B2 * 11/2011 Lai ..... 313/46
8,058,784 B2 11/2011 Treurniet
8,066,417 B2 11/2011 Balazs
8,072,130 B2 * 12/2011 Wang et al. ..... 313/318.01
8,157,418 B2 4/2012 Kraus
8,226,270 B2 * 7/2012 Yamamoto et al. ..... 362/294
2002/0012246 A1 1/2002 Rincover et al.
2002/0024814 A1 * 2/2002 Matsuba et al. ..... 362/294
2002/0118538 A1 8/2002 Calon et al.
2002/0195918 A1 12/2002 Matsuba et al.
2003/0063476 A1 4/2003 English et al.
2003/0117797 A1 6/2003 Sommers et al.
2003/0117801 A1 6/2003 Lin
2003/0137838 A1 * 7/2003 Rizkin et al. ..... 362/240
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0034077 A1 2/2006 Chang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0219428 A1 10/2006 Chinda et al.
2006/0227558 A1 10/2006 Osawa
2006/0239002 A1 10/2006 Chou et al.
2007/0002570 A1 1/2007 Souza et al.
2007/0041182 A1 2/2007 Ge et al.
2007/0096114 A1 5/2007 Aoki
2007/0103904 A1 5/2007 Chen
2007/0279903 A1 12/2007 Negley
2008/0002100 A1 1/2008 Kaneko
2008/0006911 A1 1/2008 Nakahara et al.
2008/0037255 A1 2/2008 Wang
2008/0080187 A1 * 4/2008 Purinton ..... 362/294
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van de Ven
2009/0184646 A1 7/2009 Devaney
2009/0207602 A1 8/2009 Reed
2009/0294780 A1 12/2009 Chou
2010/0026157 A1 2/2010 Tanaka
2010/0060130 A1 3/2010 Li
2010/0067241 A1 3/2010 Lapatovich
2010/0096992 A1 4/2010 Yamamoto
2010/0207534 A1 8/2010 Dowling
2010/0277082 A1 11/2010 Reed
2010/0289396 A1 11/2010 Osawa
2010/0315442 A1 12/2010 Pauritsch
2011/0079814 A1 4/2011 Chen
2011/0090691 A1 4/2011 Markle et al.
2011/0139491 A1 6/2011 Chang

FOREIGN PATENT DOCUMENTS

DE 10 2004 042186 3/2006
DE 20 2008 016 231 4/2009
EP 1705421 9/2006
EP 2037633 3/2009
EP 2149742 2/2010
EP 2 163 808 3/2010
JP 57-152706 9/1982
JP 59-035303 2/1984
JP 61-35216 2/1986
JP 62-190366 12/1987
JP 63-5581 1/1988
JP 63-102265 5/1988
JP 64-7204 1/1989
JP 1-206505 8/1989
JP 2-91105 3/1990
JP 2000-083343 3/2000
JP 2000-173303 6/2000
JP 2001-243809 9/2001
JP 2002-525814 8/2002
JP 2002-280617 9/2002
JP 2003-016808 1/2003
JP 2003-059305 2/2003
JP 2003-59330 2/2003
JP 2003-92022 3/2003
JP 2004-6096 1/2004
JP 2004-119078 4/2004
JP 2004-193053 7/2004
JP 2004-6096 8/2004
JP 2004-221042 8/2004
JP 2005-93097 4/2005
JP 2005-123200 5/2005
JP 2005-513815 5/2005
JP 2005-166578 6/2005

| | | |
|---|---|---|
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-037995 | 2/2009 |
| JP | 2009-37995 | 2/2009 |
| JP | 2009-117342 | 5/2009 |
| JP | 2009-135026 | 6/2009 |
| JP | 2009-20614 | 8/2009 |
| WO | WO 03/056636 | 7/2003 |
| WO | WO 2005/024898 | 3/2005 |
| WO | WO 2006/118457 | 11/2006 |
| WO | WO 2008/146694 | 12/2008 |
| WO | WO 2009/087897 | 7/2009 |

OTHER PUBLICATIONS

English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of Japanese Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/221,519 electronically captured on Oct. 21, 2011.
U.S. Appl. No. 13/221,551 electronically captured on Oct. 21, 2011.
U.S. Appl. No. 13/172,557 electronically captured on Oct. 21, 2011.
Related U.S. Appl. No. 12/794,379 captured on Oct. 21, 2011.
Related U.S. Appl. No. 12/794,429 captured on Oct. 21, 2011.
Related U.S. Appl. No. 12/794,476 captured on Oct. 21, 2011.
Related U.S. Appl. No. 12/794,509 captured on Oct. 21, 2011.
Related U.S. Appl. No. 12/738,081 electronically captured Oct. 21, 2011.
U.S. Appl. No. 12/885,005 electronically captured on Oct. 21, 2011.
Extended European Search Report issued in EP 111560003.9 on May 18, 2011.
Extended European Search Report issued in EP 08838942,4 on Jun. 1, 2011.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009/117342 published May 28, 2009.
English Language Abstract of JP 2004-119078 published Apr. 15, 2004.
English Language Translation of JP 2004-119078 published Apr. 15, 2004.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract and Claims of CN201072113 published Jun. 11, 2008.
English Language Abstract of CN2602514 published Feb. 4, 2004.
Extended European Search Report for EP 10179580.5, dated May 24, 2012.
U.S. Appl. No. 13/221,551 electronically captured on Sep. 24, 2012.
U.S. Appl. No. 13/172,557 electronically captured on Sep. 24, 2012.
Related U.S. Appl. No. 12/794,379 captured on Sep. 24, 2012.
Related U.S. Appl. No. 12/794,429 captured on Sep. 24, 2012.
Related U.S. Appl. No. 12/794,476 captured on Sep. 24, 2012.
Related U.S. Appl. No. 12/794,509 captured on Sep. 24, 2012.
Related U.S. Appl. No. 12/738,081 captured on Sep. 24, 2012.
U.S. Appl. No. 12/885,005 electronically captured on Sep. 24, 2012.
Related U.S. Appl. No. 12/881,795 captured on Sep. 24, 2012.
Related U.S. Appl. No. 12/713,230 captured on Sep. 24, 2012.
Related U.S. Appl. No. 12/825,956 captured on Sep. 24, 2012.
Related U.S. Appl. No. 12/845,330 captured on Sep. 24, 2012.
Related U.S. Appl. No. 12/933,969 captured on Sep. 24, 2012.
Related U.S. Appl. No. 12/885,849 captured on Sep. 24, 2012.
Related U.S. Appl. No. 12/886,025 captured on Sep. 24, 2012.
Related U.S. Appl. No. 12/886,123 captured on Sep. 24, 2012.
Related U.S. Appl. No. 13/044,369 captured on Sep. 24, 2012.
Related U.S. Appl. No. 12/888,921 captured on Sep. 24, 2012.
Related U.S. Appl. No. 13/221,519 captured on Sep. 24, 2012.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
U.S. Appl. No. 13/044,369 as of Apr. 15, 2011.
U.S. Appl. No. 12/888,921 as of Apr. 15, 2011.
U.S. Appl. No. 13/034,959 as of Apr. 15, 2011.
U.S. Appl. No. 12/794,379 captured on Apr. 15, 2011.
U.S. Appl. No. 12/794,429 captured on Apr. 15, 2011.
U.S. Appl. No. 12/794,476 captured on Apr. 15, 2011.
U.S. Appl. No. 12/794,509 captured on Apr. 15, 2011.
U.S. Appl. No. 12/794,558 captured on Apr. 15, 2011.
U.S. Appl. No. 12/738,081 captured on Apr. 15, 2011.
Language Abstract of JP 2001-243809, published Sep. 7, 2001.
English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718, published Nov. 16, 2006.
English Language Abstract of JP Publication 63-005581 published Jan. 11, 1988.
Language Abstract of JP Publication 64-007402 published Jan. 11, 1989.
English Language Machine Translation of JP 2000-083343, published Mar. 21, 2000.
English Language Machine Translation of JP 2000-173303 published Jun. 23, 2000.
English Language Machine Translation of JP 2001-243809, published Sep. 7, 2001.
English Language Machine translation of JP 2003-59330 published Feb. 28, 2003.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.

English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
English language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/825,650 captured on Nov. 11 2010.
U.S. Appl. No. 12/794,379 captured on Nov. 11 2010.
U.S. Appl. No. 12/794,429 captured on Nov. 11, 2010.
U.S. Appl. No. 12/794,476 captured on Nov. 11, 2010.
U.S. Appl. No. 12/794,509 captured on Nov. 11, 2010.
U.S. Appl. No. 12/794,558 captured on Nov. 11, 2010.
U.S. Appl. No. 12/811,795 captured on Nov. 11, 2010.
U.S. Appl. No. 12/738,081 captured on Nov. 11, 2010.
U.S. Appl. No. 12/713,230 captured on Nov. 11, 2010.
U.S. Appl. No. 12/825,956 captured on Nov. 11, 2010.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
U.S. Appl. No. 12/880,490 as of Nov. 11, 2010.
U.S. Appl. No. 12/845,330 as of Nov. 11, 2010.
U.S. Appl. No. 12/885,005 as of Nov. 11, 2010.
U.S. Appl. No. 12/933,969 as of Nov. 11, 2010.
U.S. Appl. No. 12/885,849 as of Nov. 11, 2010.
U.S. Appl. No. 12/886,025 as of Nov. 11, 2010.
U.S. Appl. No. 12/886,123 as of Nov. 11, 2010.
U.S. Appl. No. 11/399,492 (now U.S. Patent 7,758,223) as of Nov. 11, 2010.
Extended European Search Report issued in EP Appl 10006720.6 on Oct. 13, 2010.
English Language Abstract of JP 61-35216 published Feb. 2, 1086.

IPRP & WO issued in PCT/JP2008/073436 on Aug. 10, 2010.
U.S. Appl. No. 12/825,956 electronically captured on Sep. 26, 2012.
U.S. Appl. No. 12/880,490 electronically captured on Sep. 26, 2012.
Chinese Office Action issued in CN 201010243165.3 on Jul. 17, 2012.
English Language Translation of Chinese Office Action issued in CN 201010243165.3 on Jul. 17, 2012.
English Language Abstract of CN 1264152 published Aug. 23, 2000.

* cited by examiner

LAMP AND LIGHTING EQUIPMENT USING THE SAME

CROSS-REFERENCE TO RELATED APPLICATION

This application is based upon and claims the benefit of priority from prior Japanese Patent Application No. 2009-155895, filed Jun. 30, 2009, the entire contents of which are incorporated herein by reference.

FIELD

The present invention relates to a lamp having a ferrule in which light emitting elements, such as light emitting diodes are used as a light source.

BACKGROUND

Recently, a lamp using a semiconductor light emitting element with little power consumption and long life has been used in place of a filament type lamp. Especially, an electric bulb with a ferrule, such as a LED lamp which uses light emitting diodes as the light source, is adopted for various lighting equipments. In constituting the lamp with the ferrule using the light emitting diodes as a light source, it is necessary to make the lamp not only small but low cost taking advantages of the light emitting diodes.

For example, Japanese Patent Application Laid Open No. 2003-59330 (Patent Application (1)) discloses a LED lighting equipment using a LED module in a shape of an approximately plate which is easily wired. A terminal base is provided in the module to directly connect a power supply wire to the LED module in which a plurality of LED diodes is arranged on the plate. Moreover, Japanese Patent Application Laid Open No. 2006-313718 (Patent Application (2)) discloses a LED lamp including a filament type bulb having frame components, a point-like light source, a ferrule, and a translucent cover.

However, in the Patent Application (1), the power supply wire for the LED diodes is connected to a connecting portion formed on a surface of a substrate by drawing the power supply wire outside from the back side of the substrate. Therefore, the power supply wire is projected from a perimeter edge of the substrate, which results in enlargement of outer diameter of a base body of the lamp inevitably in order to take electric insulation distance from the base body of the lamp when the LED module is provided in the base body of the lamp. Accordingly, it becomes difficult to make the lamp small.

Furthermore, in the Patent Application (2), two insulating covering electric wires coupled to a point-like light source are electrically connected a patterned layer of a light source substrate by soldering after passing along a hole formed in the substrate as shown in a paragraph [0032] and FIG. 4 especially. That is, in the Patent Application (2), the electric supply wire to the light emitting diode is inserted in the substrate without taking around on the outside of the substrate as shown in (1). However, generally, the substrate is formed of metal plates with a good thermal conductivity, such as aluminum to effectively dissipate the heat from the light emitting diodes which are arranged on the surface of the substrate through an insulating layer. Accordingly, a sharp edge is formed in a through-hole to insert the wire. The sharp edge may damage the covering of the wire. Since two thin covering electric wires are used in order to flow a direct current with a lower voltage of about 24V to the light emitting diode, the thin covering of the wire tends to suffer damage. For this reason, although there is a method of cutting off the corner of the hole, it is difficult to cut off the corner because the metal plate of the substrate consists of a thin plate. Although it has been carried out to protect the electric wire by inserting a protection tube in the hole, the arrangement results in a problem that the manufacturing cost is raised because of the increase in numbers of components and manufacturing steps. In general, a protection tube is fixed in a through-hole by providing a hooking piece at both ends of the protection tube. The hooking piece is engaged at the opening of the through-hole. In this case, the hooking piece is interposed between the substrate and a radiator (frame component). Accordingly, adhesiveness between the substrate and the radiator is weakened, and the radiation efficiency is lowered.

BRIEF DESCRIPTION OF THE DRAWINGS

The accompanying drawings, which are incorporated in and constitute a portion of the specification, illustrate embodiments of the invention, and together with the general description given above and the detailed description of the embodiments given below, serve to explain the principles of the invention.

FIG. 1 shows a lamp with a ferrule according a first embodiment of the present invention.

FIG. 2 shows a supporting portion of a substrate in the lamp according to the first embodiment.

FIG. 6 is a lamp according to a fourth embodiment of the present invention.

DETAILED DESCRIPTION

Figure 1A:
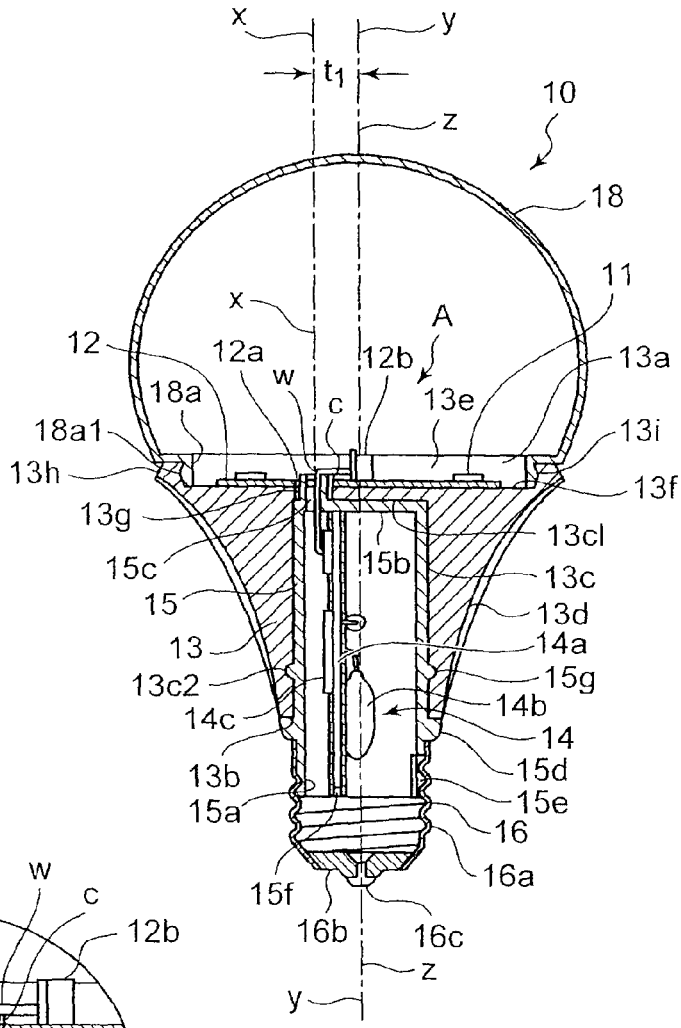
FIG. 1A is a cross-sectional view.

A lamp with a ferrule and a lighting equipment according to an exemplary embodiment of the present invention will now be described with reference to the accompanying drawings wherein the same or like reference numerals designate the same or corresponding portions throughout the several views.

The present invention was made in view of the above-mentioned problem, and offers a lamp having a ferrule and a lighting equipment in which an electric wire to supply current to a light emitting element can be easily protected.

According to one embodiment of the invention, a lamp with a ferrule includes a substrate to support a light emitting element including a wire insertion portion formed therein; a base body with a high thermal conductivity including a support portion to arrange the substrate at one end portion, a concave container portion arranged at the other end portion, and a through-hole formed in the support portion corresponding to the wire insertion portion by penetrating from the one end portion to the other end portion side; a lighting control device arranged in the concave container portion of the base body including a circuit board to mount electric parts constituting a lighting circuit for the light emitting element; an insulating case arranged between the circuit board and the concave container portion of the base body including a protection element inserted in the through-hole of the base body and the wire insertion portion of the substrate so as to project at least to inside of the wire insertion portion; a wire having one terminal connected to the lighting control device and the other terminal pulled out to the substrate side through the protection element; and a ferrule provided at the other end side of the base body and electrically connected with the lighting control device.

Hereafter, a lamp with a ferrule and a lighting equipment according to a first embodiment of the present invention is described with reference to drawings. As shown in FIG. 1 and FIG. 2, the lamp 10 with ferrule of the filament type bulb according to the first embodiment includes a light emitting element 11, a substrate 12 to support the light emitting elements 11, a base body 13 to arrange the substrate 12 at its one end portion, a lighting control device 14 including a circuit board constituting a lighting circuit, an insulating case 15 arranged between the circuit board and a concave container portion of the base body 13, an electric wire (w) in which its one end is connected to the lighting circuit and the other end is connected to the lighting element 11, and a ferrule member 16 provided at the other end portion of the base body 13.

As the light emitting element, a semiconductor light emitting element, such as a light emitting diode, an organic electroluminescence, and a semiconductor laser, etc. are used. Although it is desirable that the light source is formed of a plurality of light emitting elements, the required number may be chosen arbitrarily according to the use of lighting, for example, by making some groups in which each group consists of four elements. Of course, one group or one element may be used as a light source.

The light emitting element is desirably an SMD type (Surface Mount Device) to form a wire insertion portion in the substrate. However, the light emitting element may be formed by arranging semiconductor chips in a matrix, zigzag, or radius shape with regulation using COB (Chip On Board) method. It is desirable to constitute to emit white color. However, red, blue or green color may be emitted depending on the use of the lighting equipment. Furthermore, various kinds of colors may be also mixed according to the use of the light used.

In this embodiment, the light emitting element 11 is constituted by semiconductor elements, practically a light emitting diode (hereafter called LED). A plurality of LEDs, for example, four LEDs 11 having same characteristics are prepared. Each of the LEDs is SMD type and formed of a semiconductor chip for blue color and yellow phosphor excited by the blue LED chip. The LED emits white color with high-intensity and high-output. Furthermore, the light is mainly emitted in one direction, for example, along an optical axis of the LED chip. Here, the optical axis is approximately perpendicular to the surface of the substrate 12 where the LEDs 11 are mounted.

The substrate 12 is a component for arranging the light emitting elements as a light source, and constituted, for example, by a metal of approximately disk-like shape, such as aluminum, copper and stainless steel with a good thermal conductivity. A circuit pattern is formed on the surface of the substrate (upper side in FIG. 1A and FIG. 1B) through an electric insulating layer, such as silicone resin. Four LEDs 11 are arranged on the circuit pattern with regular interval so that the four LEDs 11 make a shape of an approximately concentric circle on the circuit pattern, as shown in FIG. 2A. Furthermore, each LED 11 is connected in series by the circuit pattern, respectively. An electric wire insertion portion 12*a* which penetrates in the substrate 12 and the electric insulating layer is formed. The material forming the substrate 12 may consist of non-metallic components, such as synthetic resin, epoxy resin, glass epoxy material, and paper phenol material. Furthermore, ceramics may be used.

A protection element 15*c* for preventing the electric wire (w) from damaged is provided in the substrate 12. Moreover, the substrate 12 is formed in arbitrary shapes such as circle, quadrangle and polygons such as hexagon, and also tabular ellipse so as to constitute a point or plane lighting module with a predetermined light distribution. In addition, although it is desirable that the electric wire insertion portion 12*a* of the substrate 12 is formed of the circular through-hole which penetrates in the substrate 12, the shape of a long hole or an angle hole, etc. may be adopted, and the shape is not limited to specific one. The electric wire insertion portion 12*a* is a circular hole penetrated from a back side to a front side of the substrate 12 so as to connect the wire (w) for supplying electric power to LED 11 with a connecting portion 12*b*. The electric wire insertion portion 12*a* is arranged so that a main axis line x-x of the electric wire insertion portion 12*a* is deviated from a center point of the substrate 12, that is, a main axis line y-y of the base body 13 to the perimeter of the substrate 12 by distance t1. An electric insulating layer is formed in the back side of the substrate 12. The insulating layer may be replaced by an insulating sheet if needed.

As mentioned above, each LED 11 mounted in the substrate 12 is arranged on one surface of the base body 13. The base body 13 is formed of a thermally conductive metal such as aluminum, and the horizontal cross-sectional shape of the base body 13 is approximately circular. In the base body 13, a concave portion 13*a* is formed on one surface, and a concave container portion 13*c* with an opening 13*b* is formed at the other end of the base body 13. Moreover, the outer surface of the base body 13 is formed so that a silhouette of a neck assembly of the base body 13 is made approximate to a common filament lamp as the diameter of the taper side of the shape of an approximately truncated cone becomes small one by one toward the other end portion from one end portion. A large number of radiating fins 13*d* which extend from one end portion to the other end portion in a radial pattern are formed in the outer surface so that the main axis line y-y is centered. The surface is painted in a metallic silver color or white color. The base body 13 formed of fleshy aluminum is processed, for example, by casting, forging, or cutting so that the base body 13 may have predetermined calorific capacity.

It is desirable that the base body 13 is made of high thermal conductive metal including at least one of aluminum (Al), copper (Cu), iron (Fe), and nickel (Ni). In addition, industrial materials, such as nitride aluminum (AlN) and silicon carbide (SiC) may be used. Furthermore, synthetic resins, such as high thermal conductive resins may be also used. It is preferable the outer surface of the base body 13 is formed so that the outer surface is made approximate to a silhouette of the neck assembly in the common filament lamp as the diameter of the taper side of the approximately truncated cone becomes small one by one toward the other end portion from one end portion because the variation to apply the lamp to lighting equipments is increased. However, the form of the lamp is not necessarily required for making a common filament lamp resemble, and can be variously changed according to the use. The base body 13 is made in one or by assembling some parts manufactured separately. For example, first a portion to support the substrate 12 and a portion to arrange a concave container portion 13*c* are manufactured separately, and then the portions are assembled. In this case, the portion to arrange the concave container portion 13*c* may be formed by a press work.

A support portion 13*f* having a smooth surface is formed so that the concave portion 13*e* is formed in the opening 13*a* of the one end portion of the base body 13 integrally. The substrate 12 to support the LED 11*s* is arranged in the concave portion 13*e*. That is, the back side of the substrate 12 is stuck to the smooth support portion 13*f* through an insulating sheet made of silicon resin, or adhesives, etc. which has high thermal conductivity and electrical insulation property, and further the substrate 12 is fixed by screw clamps. Consequently, an optic-axis z-z of the light source which consists of the LEDs 11 and the substrate 12 aligns with the main axis line y-y of the base body 13, and the light source portion A is constituted so as to have a luminescence face of an approximately circular shape in a plane as a whole.

Furthermore, a through-hole 13*g* to insert the wire (w) to supply electric power to the lighting element is formed so as to penetrate from a central region of the support portion 13*f* to a bottom 13*c*1 of the concave container portion 13*c* along the main axis line y-y in the base body 13. The through-hole 13*g* is formed in the central region so that the main axis line x-x (main axis line x-x of the electric wire insertion portion 12*a* formed on the substrate) is deviated to a perimeter direction from the main axis line y-y by the distance t1, and that the through-hole 13*g* may be commonly communicated with the electric wire insertion portion 12*a* in a concentric circle manner. A decoration portion 13*h* is formed in the perimeter of the opening 13*a* of the end portion 13*e* so as to incline below. A manufacturer name is shown in the surface of the decoration portion 13*h*. The decoration portion 13*h* may be constituted by forming a ring element of another object, and putting the ring element at the decoration portion of the perimeter of the opening 13*a*. The through-hole 13*g* formed in the base body 13 and the electric wire insertion portion 12*a* formed in the substrate 12 are respectively arranged so as to deviate from the main axis of the base body 13 toward the perimeter direction as mentioned above. Therefore, when an insulating case 15 is fitted to the substrate 12, the insulating case 15 does not rotate. When a ferrule is fitted to the insulating case 15 and the ferrule is screwed in a socket 23*a*, rotating strength is applied. However, the rotation of the insulating case 15 is prevented by above mentioned deviation. Accordingly, an additional structure for preventing the rotation is not required.

In this embodiment, the surface of the support portion 13*f* arranged at one end portion of the base body 13 is formed flat to support the substrate 12 equipped with the LEDs 11 so as to be adhered tightly. However, it is not necessary to be flat, and possible to use the substrate 12 having an unevenness surface if the substrate 12 can be stuck using thermally conductive adhesives. Although it is desirable that the through-hole 13*g* which penetrates from one end portion to the other end portion of the support portion 13*f* is formed in the central region so as to deviate slightly from the central point to the perimeter side, it is also possible to arrange the through-hole 13*g* in the central point of the support portion 13*f* or in the perimeter portion side.

The concave container portion 13*c* formed in the other end portion of the base body 13 is provided to arrange a lighting control device 14 in its inside, and the cross-sectional view is made into approximately round shape centering on the main axis line y-y of the base body 13. The through-hole 13*g* mentioned above is formed in the support portion 13*f* at the circumference of a bottom 13*c*1 (upper portion of the figure) of the concave container portion 13*c*. In the container concave portion 13*c*, the insulating case 15 is inserted to achieve electric isolation between the base body 13 made of aluminum and the circuit board 14*a* forming the lighting control device 14.

The insulating case 15 is formed of synthetic resins with heat resistance, such as PBT (poly-butylene-terephthalate), and has electrical insulation property. The opening 15*a* is formed in a lower end portion. Moreover, the blockaded bottom 15*b* is formed in the other end portion (upper end portion in figure). That is, the insulating case 15 is constituted with a form which makes the shape of a cylinder having a bottom so as to fit to the inside of the concave container portion 13*c* of the base body 13.

A protection element 15*c* for protecting the electric wire (w) is formed at the bottom 15*b* in the insulating case 15. As shown in FIG. 1B, a cylinder portion 15*c*1 of the protection element 15*c* is formed in the bottom 15*b* of the insulating case 15 made of a synthetic resin integrally so that the cylinder portion 15*c*1 is inserted in the through-hole 13*g* of the base body 13 and the electric wire insertion portion 12*a* of the substrate 12 for inserting the electric wire (w) in the inside of the cylinder portion 15*c*1. An edge portion 15*c*2 of the cylinder portion 15*c*1 is arranged so as to project a little from the surface of the substrate 12, that is, the electric wire insertion portion 12*a* when the cylinder portion 15*c*1 is inserted and fitted to the through-hole 13*g* of the base body 13 and the electric wire insertion portion 12*a* of the substrate 12. As shown in FIG. 1B, the projected distance h1 is made in a height of about 0.2-5 mm. In this embodiment, the projected distance is set to 1 mm. Thereby, the electric wire (w) can be protected from an angle portion (c) with sharp edge by covering the inner surface of the electric wire insertion portion 12*a*, especially the angle portion (c) of a hole with a synthetic resin. Simultaneously, the electric wire (w) is protected even from the metal inner surface of the through-hole 13*g* made of aluminum. In addition, when the projected distance hi of the edge portion 15*c*2 in the protection element 15*c* is less than 0.2 mm, there is a possibility that the edge portion 15*c*2 may not project due to a manufacturing error, and when it exceeds 5 mm, there is a possibility of generating a shadow of the light emitted from the LEDs.

In this embodiment, the protection element 15*c* of the insulating case 15 is formed of the cylinder portion 15*c*1 arranged in the bottom 15*b* of the insulating case 15 so that the cylinder portion 15*c*1 is inserted in the through-hole 13*g* of the base 13 and the electric wire insertion portion 12*a* of the substrate 12. The electric wire (w), particularly its covering is protected by making the cylinder portion 15*c*1 project to inside of the electric wire insertion portion 12*a* and covering the angle portion (c) having the sharp edge of the electric wire insertion portion 12*a* with the cylinder portion 15*c*1. Although the edge portion 15*c*2 of the cylinder portion 15*c*1 is made to project a little from the surface of the substrate 12 in this embodiment and covers the angle portion (c) with the edge portion 15*c*2 of the cylinder portion 15*c*1; it may not be conditions to make the edge portion 15*c*2 project a little from the surface of the substrate 12, and the edge portion 15*c*2 and the surface of the substrate 12 may be flush. Moreover, the cylinder portion 15*c*1 of the protection element 15*c* may be formed integrally at the time of fabrication of the insulating case 15 made of the synthetic resin, or the cylinder portion 15*c*1 formed of another object may be unified with the insulating case 15 using adhesives etc.

Moreover, in this embodiment, the protection element 15*c* is formed so as to project to inside of both the through-hole 13*g* and the electric wire insertion portion 12*a* made of metal in which electric wire (w) is inserted, and thereby protects the electric wire (w) from both the through-hole 13*g* and the electric wire insertion portion 12*a*. However, in many cases, the through-hole 13*g* is constituted so that the electric wire (w) does not contact with the angle portion (c) of the through-hole 13*g*. Therefore, the whole inner surface of the through-hole 13*g* may not be covered with the protection element 15*c*, and may be partially exposed. Consequently, what is necessary is just to form the protection element 15*c* so as to project at least to inside of the electric wire insertion portion 12*a* in which the angle portion c is formed.

A projected locking portion 15*d* is integrally formed in the perimeter outer surface of the insulating case 15 located in an interstitial region of the outer surface in a ring-like sword guard shape. The perimeter outer surface of the insulating case 15 projected from the locking portion 15*d* toward down side in Figure is made stage-like to form a ferrule attachment portion 15*e*, and the ferrule is fitted to the stage-like ferrule attachment portion 15*e*. A guide slot 15*f* is integrally formed in the inner surface along an axis of the cylindrical insulating case 15. The plate-like circuit board 14*a* is fitted to the slot and supported in a vertical direction, that is, along with the main axis line y-y of the base body 13. Consequently, the guide slot 15*f* is formed so as to deviate from the center axis y-y of the base body 13 to one side, that is, a side in which the protection element 15*c* is formed to insert the electric wire (w). The circuit board 14*a* is inserted and fitted in the guide slot formed eccentrically in the vertical direction.

As mentioned above, the insulating case 15 is interposed between the circuit board 14*a* and the concave container portion 13*c* of the base body 13, and makes electric insulation between the circuit board 14*a* and the base body 13. Although PBT (poly-butylene-terephthalate) is used in this embodiment as a synthetic resin which has electrical insulation property and heat resistance, other synthetic resins such as acrylics and an ABS, or an electric insulator other than synthetic resins, such as wood pulp and synthetic rubber may be also used.

The circuit board 14*a* made of glass epoxy constitutes a lighting control device 14 in which electronic components are mounted to form a lighting circuit 19 for the LEDs 11. Comparatively large parts 14*b*, such as an electrolytic condenser are mounted in one side (right-hand side in the figure) of the circuit board 14*a*. On the other hand, parts 14*c* accompanied by heat generation such as small chip components and transistors, etc. are mounted in a surface of another side (left-hand side in the figure). The circuit board 14*a* equipped with the electrical parts is inserted and fitted to the guide slot 15*f* of the insulating case 15 in the vertical direction so that the side equipped with the parts 14*c* accompanied by heat generation, such as small chip components and transistors, etc. faces a small space side, i.e., the side in which the protection element 15*c* is formed, and that another side in which the large parts 14*b* are mounted faces a large space. Consequently, the electric insulation between the circuit boards 14*a* of the lighting control device 14 and the base body 13 is made by the insulating case 15. The lighting control device 14 may include a modulated lighting circuit for modulating the emitted light from the emitting element 11. In this embodiment, all the components constituting the lighting control device 14 are accommodated in the concave container portion 13*c* of the base body 13. However, some of the components may be accommodated in the ferrule 16.

The circuit board 14*a* equipped with electric parts and constituting the lighting circuit 19 for the light emitting element 11 may be formed of not only glass epoxy material but non-metallic material such as paper phenol material and glass composite, or thermally conductive metal, such as aluminum in order to improve heat dissipation nature. In addition, ceramics can be used. In this embodiment, the circuit board 14*a* of the lighting control device 14 is arranged in the concave container portion 13*c* along the main axis line of the base portion 13 in order to attain a miniaturization, but may be arranged so as to incline aslant. The internal state where the circuit board 14*a* of the lighting control device 14 is arranged in the concave container portion 13*c* of the base body 13 is made airtight to prevent invasion of dust etc., or made to communicate with the exterior for heat dissipation and decrease in pressure by making an air hole.

Figure 3:
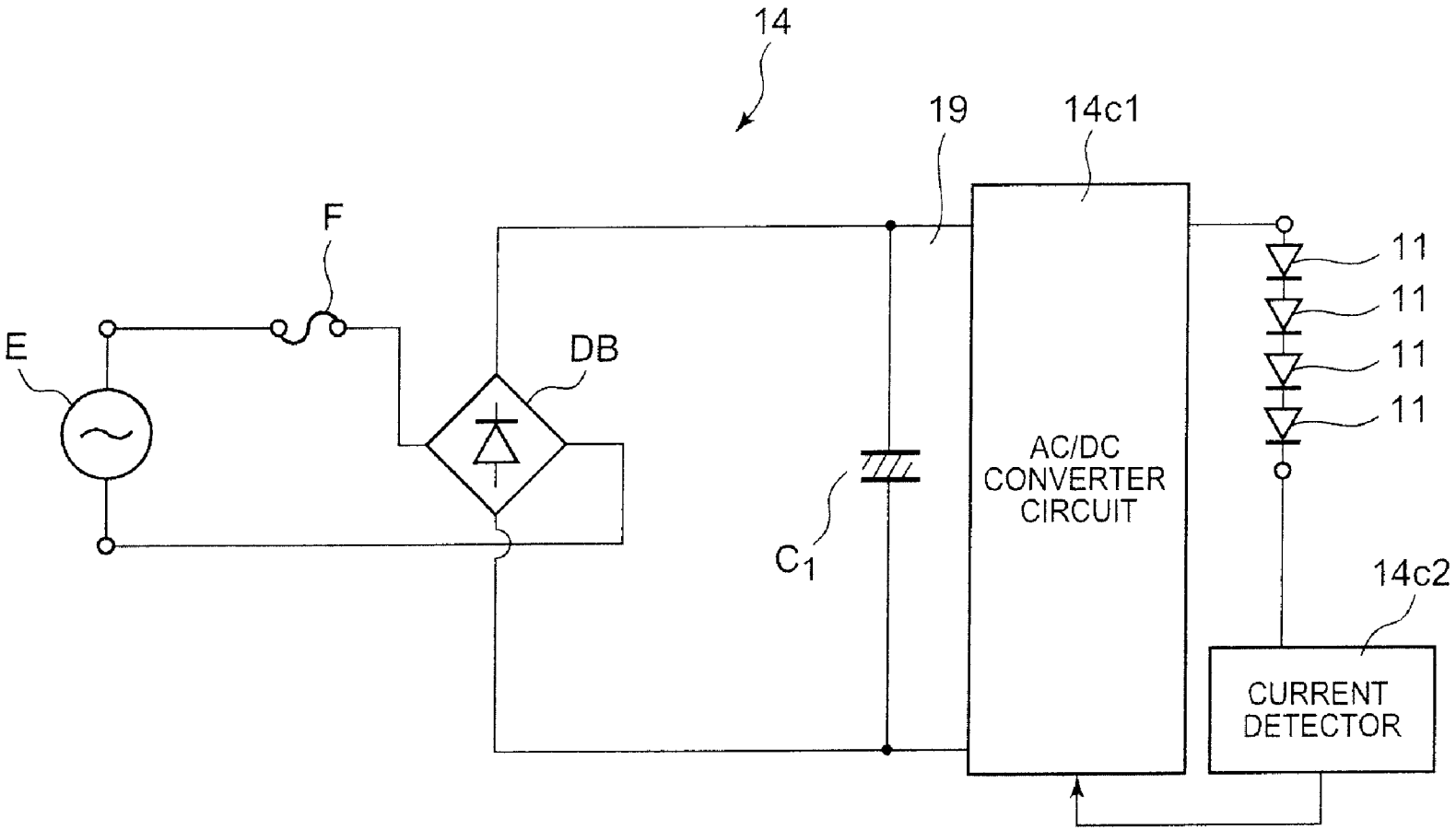
FIG. 3 is a circuit diagram showing a lighting circuit used for the lamp according to the first embodiment of the present invention.

As schematically shown in FIG. 3, the lighting circuit 19 rectifies and makes smooth the alternating voltage of 100V for a commercial power source E by diode bridge DB, a smoothing capacitor C1, and an AC/DC converter 14*c*1, and converts the power source E into a direct-current voltage of 24V. The direct-current is controlled by a current circuit detector 14*c*2, and supplied to LEDs 11. Each LED lights up and emits light when the controlled current flows into each LED 11.

Moreover, the electric wire (w) for supplying electric power to LEDs 11 is connected to an output terminal of the circuit board 14*a*. An output terminal of the electric wire (w) is inserted in the through-hole 13*g* of the base body 13 and the electric wire insertion portion 12*a* of the substrate 12 through the cylinder portion 15*c*1 of the protection element 15*c* from the bottom 15*b* of the insulating case 15 mentioned above, and pulled out to the surface side of the substrate 12. Moreover, an input terminal of the circuit board 14*a* is connected with the ferrule 16 by means of an input wire (not shown). Any kinds of wires such as a wire with insulating covering, a twisted wire and a flat cable are used as the wire (w).

The electric wire (w) connected to the substrate 12 side is a means for supplying the output of the lighting control device 14 to the light emitting element 11. As the electric wire (w), a covering lead wire is used. The shape and the size are designed so that the covering lead wire can be inserted in the through-hole 13*g* of the base body 13 and the electric wire insertion portion 12*a* of the substrate 12. In this embodiment, the electric wire (w) is connected to the light emitting element 11 on the substrate 12 through an electric connection portion such as a connector 12*b*. However, the electric wire (w) may be directly connected with a wiring pattern formed on the substrate 12 by means of soldering or screws. It is also possible to directly connect the electric wire (w) to the lighting elements 11 without using the wiring pattern.

The ferrule 16 is fitted to the perimeter surface of the ferrule attachment portion 15*e* of the insulating case 15 projected from the opening 13*b* of the other end portion of the base body 13 and caulked or adhered by adhesives having heat resistance such as silicon resin and epoxy resin. Thereby, the whole appearance of the perimeter surface from the base body 13 to the ferrule 16 is formed so as to be approximated to the silhouette of the neck assembly of the common filament lamp.

Figure 1B:
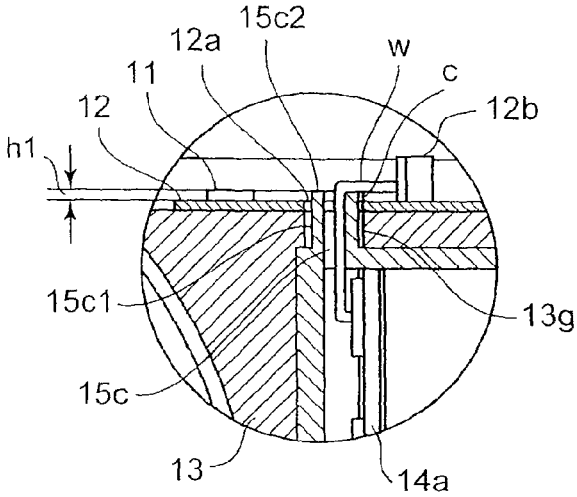
FIG. 1B is an enlarged cross-sectional view showing a main portion.
Figure 2A:
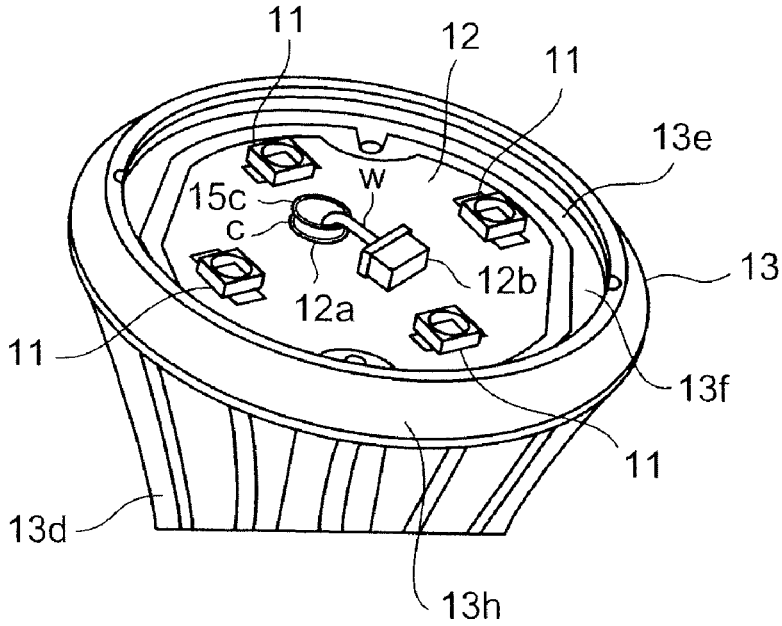
FIG. 2A is a perspective view showing a state in which the substrate is supported.

As shown in FIG. 1A, the ferrule portion 16 is an Edison E26 type, and includes a cylindrical shell portion 16*a* equipped with a screw thread and an eyelet portion 16*c* provided in a top portion of the lower end of the cylindrical shell portion 16*a* through an insulating portion 16*b*. The opening portion of the shell portion 16*a* is fitted to the ferrule attachment portion 15*e* of the insulating case 15, and adhered by adhesion or caulking. Thereby, the electric insulation between the base body 13 made of aluminum and the ferrule 16 is carried out. A pair of input cables drawn from the input terminal of the circuit board 14*a* is connected to the shell portion 16*a* and the eyelet portion 16*c* of the ferrule 16.

In this embodiment, the same ferrule 16 as that of common filament lamp is used. Accordingly, the lamp according to this embodiment can be screwed to the same socket for the filament lamp. Edison types E26 and E17 which are widely used and suitable as the ferrule 16. The whole ferrule 16 may be formed of metal, or only a connecting portion of the ferrule 16 may be made of metal plate such as copper in which other portion is made of a resin. Furthermore, the ferrule 16 may include a pin type terminal used for a fluorescence lamp or a terminal of L type used for a hooking ceiling. Therefore, the ferrule 16 is not limited to a specific one.

A protrusion 15*g* shown in FIG. 1A is integrally formed in the outer surface of the insulating case 15, and fitted to engaging slot 13*c*2 formed in the perimeter surface of the concave container portion 13*c*. Therefore, the fall of the insulating case 15 and the ferrule 16 from the concave container portion 13*c* is prevented.

A globe 18 constituting a transparent cover is formed of, for example, glass with thin thickness or synthetic resin. The globe 18 is formed of polycarbonate of milk white color which is transparent or optically diffusible. The globe 18 is formed in a shape approximated to the silhouette of the ball portion of the common filament lamp having an opening 18*a* at an end portion with a smooth curved surface.

The globe 18 is fixed to the base body 13 so that a projected portion 18*a*1 formed in the opening end of the globe 18 is fitted to a slot 13*i* formed in an inner surface of the support portion 13*f* of the base body 13 and that the globe 18 covers the light source portion A. Furthermore, the globe 18 is fixed with adhesives, such as silicone resin and epoxy resin. Thereby, while LED 11 and the wiring portion are covered and protected, the perimeter surface of the base body 13 turns into appearance which is contiguous to the globe 18 in one. Therefore, the lamp 10 of the electric bulb type is constituted. The whole form of the lamp 10 is more approximate to the silhouette of the common filament lamp.

Figure 2B:
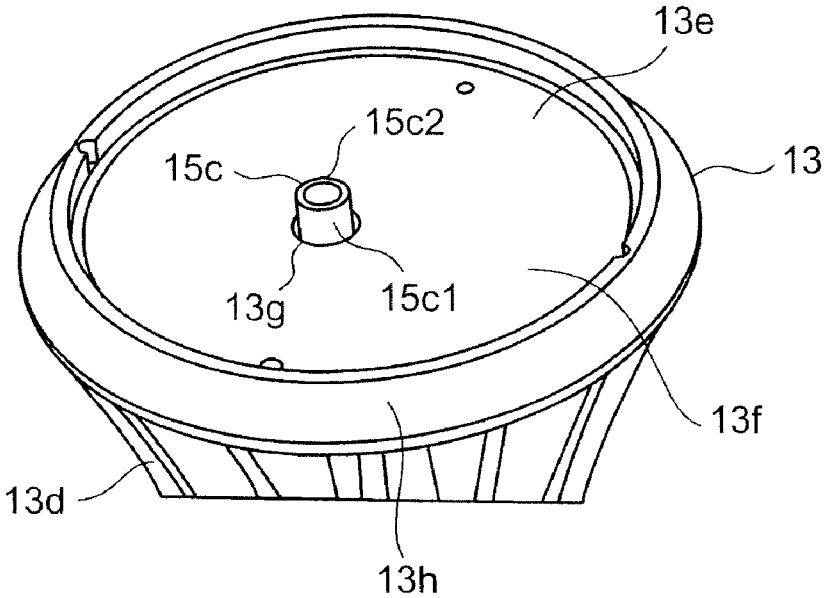
FIG. 2B is a perspective view showing a state where the substrate is removed.

Next, an assembly process of the lamp 10 with a ferrule of an electric bulb form constituted as above is explained. First, the insulating case 15 is fitted to the concave container portion 13*c* of the base body 13 so that the bottom 15*b* of the insulating case 15 faces the bottom 13*c*1 of the concave container portion 13*c*. At this time, the cylinder 15*c*1 of the protection element 15*c* formed in the insulating case 15 is aligned with the through-hole 13*g*, and inserted into the through-hole 13*g*, and then fitted as shown in FIG. 2B. Simultaneously, the projected portion 15*g* of the insulating case 15 is fitted to the slot 13*c*2 of the concave container portion 13*c* and fixed. Accordingly, the edge portion 15*c*2 of the cylinder 15*c*1 is projected from the surface of the support portion 13*f* of the base body 13.

Then, the circuit substrate 14*a* is fitted to the guide slots 15*f* in vertical direction and supported in the insulating case 15 so that the electric wire (w) beforehand connected to the output terminal of the circuit board 14*a* is inserted from the bottom 13*c*1 of the insulating case 15 to the cylinder 15*c*1 of the protection element 15*c*. At this time, the circuit substrate 14*a* is fitted in the insulating case 15 so that the heat dissipation parts 14 are located in the side in which the protection element 15*c* is provided. The end portion of the electric wire (w) is kept to be pulled out from the electric wire insertion portion 12*a* of the substrate 12 in which the LEDs 11 are mounted.

Next, as shown in FIG. 2A, the substrate 12 in which the LEDs 11 are mounted is laid on the support portion 13*f* of the base body 13 so as to stick, and fixed by using fastener means such as screws, for example, four screws from the periphery of the upper surface side. The edge portion 15*c*2 of the protection element 15*c* in advance projected from the support portion 13*f* is inserted in the electric wire insertion portion 12*a* after position alignment of the through 13*g* of the base body 13 and the electric wire insertion portion 12*a* of the substrate 12 is carried out. Thereby, the cylinder 15*c*1 which constitutes the protection element 15*c* is projected in the inside of the hole of the electric wire insertion portion 12*a*. The edge portion 15*c*2 is a little projected from the surface of the substrate 12, i.e., the hole of the electric wire insertion portion 12*a*, in a height of about 1 mm. in this embodiment. Simultaneously, the back side of the substrate 12 and the smooth surface of the support portion 13*f* are stuck, and fixed so that thermal conduction is achieved therebetween.

Next, one end of the electric wire (w) pulled out from the electric wire insertion portion 12*a* of the substrate 12 is connected with the wire connecting portion 12*b* by bending toward to the center side of the substrate 12. The angle portion (c) of the hole of the electric wire insertion portion 12*a* is covered with the edge portion 15*c*2 of the cylinder 15*c*1 projected in a height of about 1 mm. Thereby, the electric wire (w) is supported without contacting with the angle portion (c) while protected from the sharp edge of the angle portion (c) made of metal. Accordingly, when pulling out the edge portion of the electric wire (w) from the electric wire insertion portion 12*a* of the substrate 12, or when connecting the electric wire (w) with the connecting portion 12*b* by bending, the covering of the electric wire (w) is not damaged. In addition, it is desirable that the electric wire (w) is connected to the connection portion 12*b* along the surface of the substrate 12 so that the wire may not become hindrance of the light from the light emitting element 11. Moreover, it is desirable to set the size of the inside diameter of the cylinder 15*c*1 so that the excess slacked electric wire (w) on the surface of the substrate 12 can be accommodated in the inside of the cylinder 15*c*1 and that a large drawing strength is not applied to the cylinder 15*c*1 when the electric wire (w) is pulled out.

Then, the input wire (not shown) pulled out from the input terminal of the circuit board 14*a* is connected with the shell portion 16*a* and the eyelet portion 16*c*. While keeping above connection, an opening portion of the shell portion 16*a* is fitted to the ferrule attachment portion 15*e* of the insulating case 15, and fixed with adhesives.

Next, the globe 18 is attached to the base body 13 so as to cover the light source portion A in which the projected portion 18*a*1 of the opening portion 18*a* of the globe 18 is fitted to the slot 13*i* formed in the support portion 13*f* of the base body 13, and fixed with adhesives. Thereby, the lamp 10 with the globe 18 at one end and the ferrule of E26 type at another end of the base body 13 is constituted. The whole appearance of the lamp 10 is approximated to the silhouette of the common filament lamp (PS type).

Figure 4:
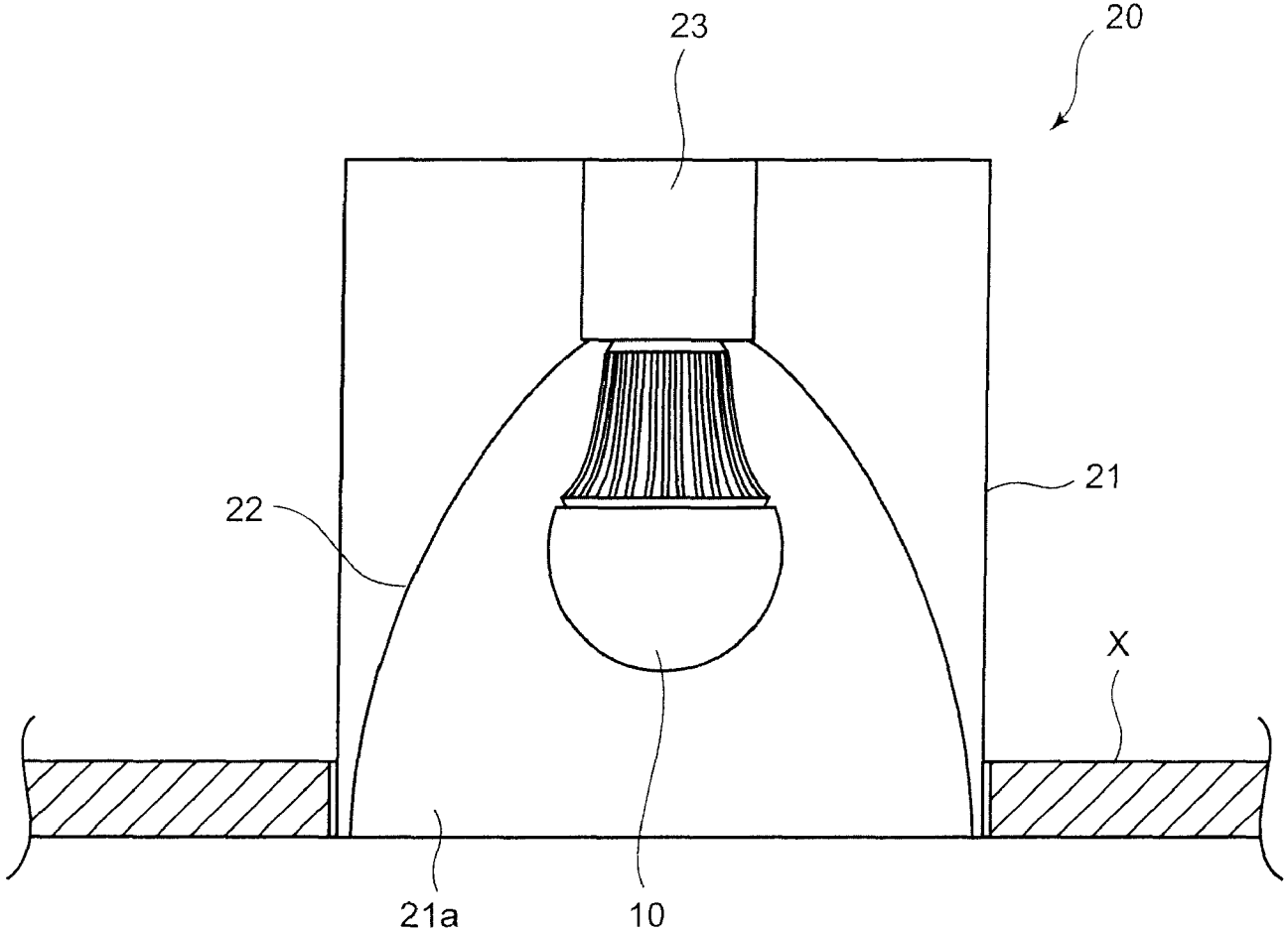
FIG. 4 is a cross-sectional view schematically showing a state in which a lighting equipment having the lamp according to the first embodiment of the present invention is attached to a ceiling.

A structure of a lighting equipment is explained in which the lamp 10 with the ferrule constituted as mentioned above is used as the light source. FIG. 4 shows a down-light type equipment which is embedded in a ceiling and uses the common filament lamp having the E26 type ferrule as the light source, for example, for use by store etc. The down-light type equipment 20 includes a base case 21 made of metal with an opening 21*a* provided in a downside in a box shape, a reflector 22 made of metal fitted to the opening 21*a*, and a socket 23 to which the E26 type ferrule of the common filament lamp is screwed. The reflector 22 is formed of, for example, metal plates, such as stainless, and the socket 23 is installed in a center portion of an upper board of the reflector 22.

In the existing lighting equipment 20 for common filament lamps constituted as mentioned above, the LED lamp 10 with the ferrule is used as light source in place of the filament lamp for energy saving and extension of life. That is, since the ferrule 16 of the LED lamp 10 is constituted in the E26 type, it is possible to screw the LED lamp 10 in the socket 23 for the common filament lamps of the above-mentioned lighting equipment without modification. Further, since the appearance of the LED lamp is constituted by the form approximated to the silhouette of the neck assembly in the filament lamp by making the base body 13 of the lamp 10 with the ferrule so as to have a substantially conic taper side, it become possible to screw the lamp 10 smoothly to the socket 13 without contacting with the reflector 22. Furthermore, it becomes possible to more widely apply the LED lamp 10 with the ferrule to the existing lighting equipment. Accordingly, a saved-energy type down-light is constituted, in which the LED lamp with the ferrule of the filament type is installed as the light source.

Next, an operation of the down-light using the LED lamp with ferrule constituted as mentioned above is explained as a light source. If power is supplied to the down-light by switch, the commercial power E is supplied through the ferrule of the LED lamp 10 from the socket 23. As shown in FIG. 3, the lighting circuit 19 rectifies the commercial power E and makes smooth the alternating voltage of 100V, by the diode bridge DB, a smoothing capacitor C1, and the AC/DC converter 14*c*1, and converts the alternating voltage into a direct-current voltage of 24V. The direct-current is controlled by a current circuit detector 14*c*2, and supplied to LEDs 11. Each LED simultaneously lights up and emits white light when the controlled current flows into each LED 11.

Four LEDs 11 are mounted on the surface of the substrate 12 in a shape of an approximately concentric circle with regular distance. Therefore, the light emitted from each LED is uniformly emanated to the whole inside of the globe 18 and distributed by the milky globe 18. Furthermore, lighting with the light distribution characteristic approximated to the common filament lamp can be performed. Particularly, the light is also emitted to a lower portion (the ferrule portion) from the lower expanding end side of the globe, which is formed of the decoration portion 13*h* inclining to the lower direction. Accordingly, the lighting with a distribution characteristic more approximated to the common filament lamp can be performed.

Especially, the distribution of the light from the LED lamp 10 with ferrule as a light source approaches to that of the light by a common filament lamp. Accordingly, in the lighting equipment 20, the amount of irradiation of the light to the reflector 22 around the socket 23 increases. Thereby, even if the reflector 22 designed for the common filament lamps is used, the same instrument characteristic can be obtained when the LED lamp according to the embodiment is used as the light source.

Moreover, if the LED lamp 10 of the electric bulb type is turned on, the temperature of each LEDs 11 rises and heat is generated. The heat from the disk-like substrate 12 is transferred to the support portion 13*f* of the base body 13 to which the substrate 12 is fixed so as to stick. Furthermore, the heat is radiated in the open air through the radiating fin 13*d* of the base body 13. Since the base body 13 and the substrate 12 are made of thermally conductive aluminum, and the substrate 12 is supported by the base body 13*f* in close contact, it becomes possible to dissipate the heat generated in the LEDs 11 effectively by lessening a heat conduction loss. Accordingly, rising of temperature and temperature unevenness of each LED 11 are prevented, and the lowering of the light emission efficiency is suppressed, which results in prevention of the fall of illumination intensity due to a luminous flux fall. Simultaneously, long life of the LEDs can be attained. Moreover, since a weight saving can be carried out by using aluminum as the base body, it is possible to suppress that the LED lamp becomes heavy.

Moreover, even if the LED lamp 10 receives vibration during conveyance or use and the electric wire (w) vibrates, the electric wire (w) is supported without contacting with the angle portion (c) because the cylinder 15*c*1 which constitutes the protection component 15*c* projects to inside of the hole of the electric wire insertion portion 12*a*, and the angle portion (c) of the hole of the electric wire insertion portion 12*a* made of aluminum is covered with the edge portion 15*c*2. Accordingly, the covering of the wire (w) is not damaged.

As mentioned above, according to the LED lamp of this embodiment, four LEDs 11 are arranged in the surface of the substrate 12 in an approximately concentric circle with predetermined distance. Accordingly, the light emitted equally toward to the whole inside of the globe 18 is diffused by the milky color globe 18. Therefore, the lighting with the light distribution characteristic approximated to the common filament lamp can be performed. Particularly, the light is also emitted to a lower portion (the ferrule portion) from the lower expanding end side formed of the decoration portion 13*h* inclining to the lower direction. Accordingly, the lighting with distribution characteristic more approximated to the common filament lamp can be performed. Simultaneously, since the electric wire (w) for supplying electric power to the LEDs 11 is pulled out from the electric wire insertion portion 12*a* formed in the center region of the substrate 12 by deviating to the perimeter edge side by only the distance t1, the electric wire (w) is not projected from the perimeter edge side as shown in the Patent Application (1). For this reason, when the substrate 12 is quipped in the support portion 13*f* of the base body 13, it becomes unnecessary to take the electric insulation distance between the electric wire (w) and the base body 13, which results in decrease in the size of the radius of the base body 13. Accordingly, the miniaturization of the whole lamp can be attained. Moreover, since the electric wire insertion portion 12*a* of the substrate 12 and the through-hole 13*g* of the base body 13 are formed in the central region of the substrate 12 so that the central axis x-x deviates from central axis y-y of the base body 13 in the perimeter direction by only the distance t1, it becomes possible to shorten the length of the electric wire required for wiring as much as possible, which results in advantage of manufacturing cost.

The cylinder 15*c*1 which constitutes the protection element 15*c* projects to inside the hole of the electric wire insertion portion 12*a*, and the angle portion (c) of the hole of the electric wire insertion portion 12*a* made of aluminum is covered with the edge portion 15*c*2. Accordingly, the electric wire (w) is supported without contacting with the angle portion (c), and the covering of the wire (w) is not damaged. Moreover, even if the LED lamp 10 receives vibration during conveyance, or use, and the electric wire (w) vibrates, the covering of the wire (w) is not damaged. Accordingly, the occurrence of the short circuit, or an electrical leak accident, etc. of the electric wire (w) can be prevented certainly, and a safe and long-life lamp can be offered.

Especially, since the edge portion 15*c*2 of the protection element 15*c* is projected from the surface of the substrate 12 in a height of about 1 mm, the angle portion (c) of the electric wire insertion portion 12*a* can be covered more certainly, and the electric wire (w) can be protected from the damage certainly.

Moreover, since the protection elements 15*c* are integrally formed with the insulating case 15 made of synthetic resin, it is not required that the exclusive tube for protection element 15*c* is prepared as an exclusive part. Accordingly, it becomes possible to offer a lamp which is advantageous in cost The cylinder 15*c*1 is automatically inserted in the through-hole 13*g* of the base body 13 when the protection element 15*c* is installed in the concave container portion 13*c* of the insulated case 15. Accordingly, the cylinder 15*c*1 is easily provided without requiring additional assembling work, which results in further advantage in cost due to reduction in manufacturing cost.

Furthermore, the electric wire (w) is protected by the protection element 15*c* in advance so that covering of the electric wire (w) may not be damaged in the assembling work. Therefore, it becomes easy to carry out assembling work, which results in, reduction of a manufacturing cost, and it becomes possible to offer an advantageous lamp which is suitable for mass production.

Figure 5A:
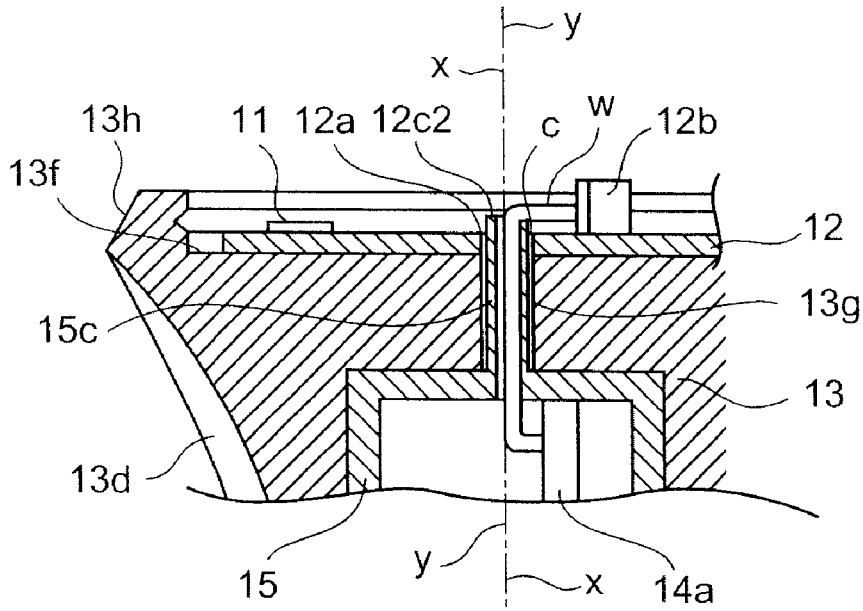
FIG. 5A is a cross-sectional view showing a supporting portion of a substrate in a second embodiment by enlarging a main portion.
Figure 5B:
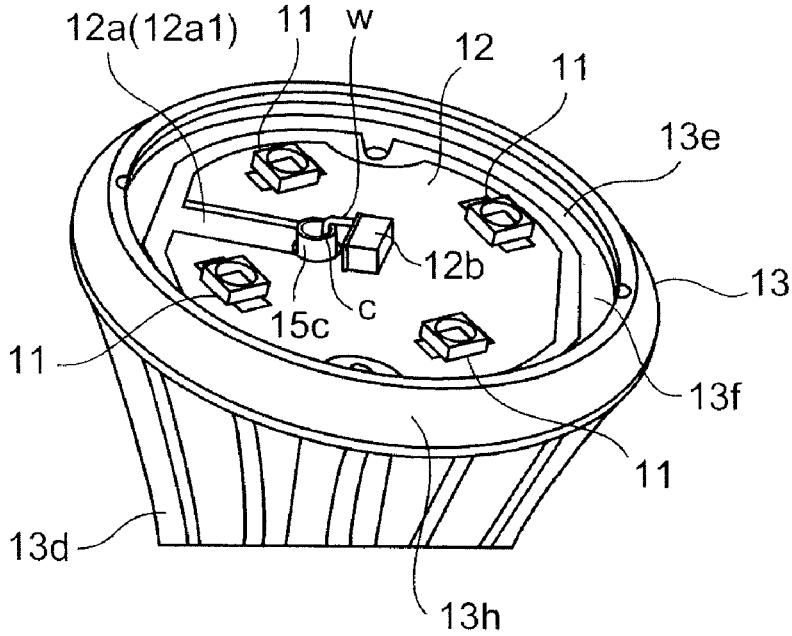
FIG. 5B is a perspective view showing a supporting portion of a substrate in a third embodiment of the invention.

Although, in the first embodiment, the through-hole 13*g* of the base body 13 is formed in a central region of the substrate 12 so that the central axis x-x deviates from the central axis y-y of the base body 13 in the perimeter direction by only the distance 0, the through-hole 13*g* of the base body 13 may be arranged in the central region of the support portion 13*f* by aligning the central axis y-y of the base body 13 with the central axis x-x of through-hole 13*g* in a second embodiment shown in FIG. 5A. FIG. 5B shows a third embodiment. The electric wire insertion portion 12*a* of the substrate 12 is formed of a slit portion 12*a*1 of a shape of a long hole opened to the periphery of the substrate 12 instead of a circular hole like a first embodiment as shown in FIG. 1. According to this structure, it is not necessary to let the electric wire (w) pass targeting the small circular hole of the electric wire insertion portion 12*a*, and the electric wire (w) can be passed through the slit portion 12*a*1 from the perimeter edge of the substrate 12. Accordingly, the workability can be improved more.

Figure 6A:
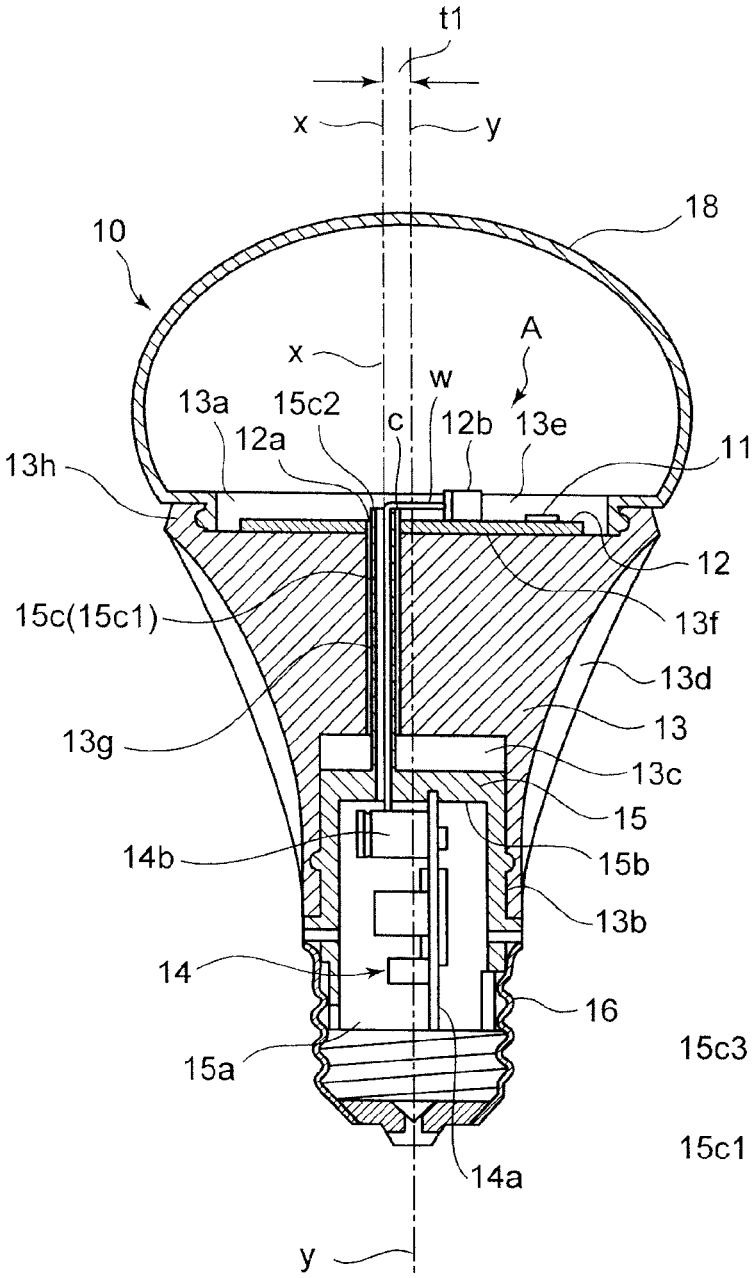
FIG. 6A is a cross-sectional view.
Figure 6B:
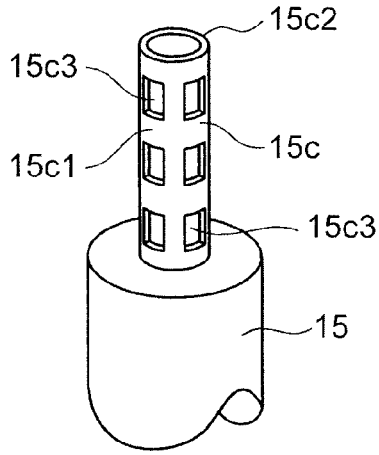
FIG. 6B is a partially cut away perspective view showing a protection element of an insulating case.

In the fourth embodiment shown in FIG. 6A, the concave container portion 13*c* of the base body 13 is made shallow to increase the calorific capacity of the base body 13 made of aluminum. The small type lamp with the ferrule of the above construction is compatible to a mini krypton electric bulb In this case, the cylinder 15*c*1 of the protection element 15*c* is lengthened, and the circumferential side of the cylinder 14*c*1 is made into a shape of a lattice, and many through-holes 15*c*3 are formed. The edge portion 15*c*2 is constituted so that the angle part (c) of the hole of the electric wire insertion portion 12*a* of the substrate 12 is covered with the edge portion 15*c*2 of the protection element 15*c*. According to the above structure, it become possible to increase the calorific capacity of the base body 13 more while the cost of materials of the insulating case 15 made of synthetic resins can be reduced by making the circumferential side of the cylinder 15*c*1 into the shape of a lattice.

Moreover, the surface portion of the base body 13 exposed to outside may be formed, for example, in an unevenness shape or in a satin shape to enlarge the surface portion, or white alumite treatment may be also performed to raise the thermal emissivity of the surface portion. In a case where the alumite treatment is performed and metallic silver color or white color is painted on the surface of the outer surface like the embodiments, the reflectance of the external surface of the base body 13 made of aluminum exposed outside becomes high when the lighting equipment 20 equipped with the LED lamp 10 is turned on. Furthermore, the appearance and design of the lamp becomes better. Accordingly, it becomes possible to raise both a light emission ratio and, marketability. Moreover, the globe 18 may be constituted by a transparent or a translucent protective cover for protecting the wiring portion of LEDs 11 from the exterior.

In the embodiments, the LED lamp with ferrule may be constituted so as to be approximated to the shape of the common filament lamp, such as electric bulb form (A type or PS type) a reflex form (R type), a ball form (G type), and a cylinder form (T type), etc. Furthermore, the LED lamp 10 is constituted without the globe (globe less type). Moreover, the present invention is applicable not only to the lamp with the ferrule approximated to the form of a common filament lamp but the LED lamp which, in addition to above, makes various kinds of appearance form and uses.

The LED lamp with the ferrule according to this embodiment is applied to lighting equipments, such as a direct attachment type for a ceiling, a ceiling hooked type, a wall attachment type, and a down-light embedded in the ceiling. Moreover, the LED lamp 10 may be equipped with a globe, a shade, a reflector, etc. as an emitted light controlling means, and may be constituted so that the lighting element is exposed without the emitted light controlling means. The lighting equipment 20 is equipped with not only one lamp but also two or more lamps. Furthermore, the lighting equipment according to the embodiments is also applicable to the large-sized lighting equipment for an institution and use for offices, etc.

While certain embodiments have been described, these embodiments have been presented by way of example only, and are not intended to limit the scope of the inventions. In practice, the structural elements can be modified without departing from the spirit of the invention. Various embodiments can be made by properly combining the structural elements disclosed in the embodiments. For example, some structural elements may be omitted from all the structural elements disclosed in the embodiments. Furthermore, structural elements in different embodiments may properly be combined. The accompanying claims and their equivalents are intended to cover such forms or modifications as would fall with the scope and spirit of the inventions.

What is claimed is:

1. A lamp with a ferrule comprising:

a substrate to support a light emitting element including a wire insertion portion formed therein;

a base body with a high thermal conductivity including a support portion to arrange the substrate at one end portion, a concave container portion arranged at the other end portion, and a through-hole formed in the support portion corresponding to the wire insertion portion by penetrating from the one end portion to the other end portion side;

a lighting control device arranged in the concave container portion of the base body including a circuit board to mount electric parts constituting a lighting circuit for the light emitting element;

an insulating case arranged between the circuit board and the concave container portion of the base body including a protection element inserted in the through-hole of the base body and the wire insertion portion of the substrate so as to project at least to inside of the wire insertion portion;

a wire having one terminal connected to the lighting control device and the other terminal milled out to the substrate side through the protection element; and a ferrule provided at the other end side of the base body and electrically connected with the lighting control device.

2. The lamp with a ferrule according to claim 1, wherein the base body is formed in a circular truncated cone shape having one end portion larger than the other end portion, and the through-hole formed in the base body and the wire insertion portion formed in the substrate are arranged so as to deviate from a central axis of the base body.

3. The lamp with a ferrule according to claim 2, wherein the circuit board equipped in the concave container portion includes first and second surfaces and is arranged to divide the concave container portion into first and second surface side portions, and heat dissipation circuit parts of the lighting control device are arranged in the first surface side portion and the other circuit parts are arranged in the second surface side portion, and wherein the first surface side portion of the concave container portion is communicated with the through-hole formed in the base body and the wire insertion portion formed in the substrate.

4. The lamp with a ferrule according to claim 1, wherein the protection element formed in the insulating case is arranged so as to project from the surface of the substrate.

5. The lamp with a ferrule according to claim 1, wherein the protection element formed in the insulating case is arranged so that an edge portion of the protection element is flush with the surface of the substrate.

6. The lamp with a ferrule according to claim 1, wherein the wire pulled out through the protection element is connected with a connector arranged on the surface of the substrate, and further the connector is connected to a wiring pattern for connecting between the light emitting elements.

7. The lamp with a ferrule according to claim 1, wherein the electric wire insertion portion of the substrate is formed of a slit in a long hole shape opened to a periphery of the substrate.

8. The lamp with a ferrule according to claim 1, wherein the base body is formed in a circular truncated cone shape having one end portion larger than the other end portion, and the through-hole formed in the base body and the wire insertion portion formed in the substrate are arranged in alignment with a central axis of the base body.

9. The lamp with a ferrule according to claim 1, wherein the insulating case is arranged in the other end portion of the base body, and the protection element includes a cylinder having a plurality of holes formed in a side face in a grid shape.

10. The lamp with a ferrule according to claim 9, wherein the lamp with a ferrule is compatible to a mini krypton electric bulb.

11. The lamp with a ferrule according to claim 2, further comprising a cover element provided at the one end portion of the base body to cover the substrate, wherein the cover element, the base body and the ferrule provided at the other end portion of the base body form a whole appearance of a lamp approximated to a silhouette of a filament lamp (PS type).

12. The lamp with a ferrule according to claim 11, the ferrule includes a shell portion and an eyelet portion.

13. A lighting equipment having a socket and a lamp with a ferrule, the lamp with a ferrule comprising:

a substrate to support a light emitting element including a wire insertion portion formed therein;

a base body with a high thermal conductivity including a support portion to arrange the substrate at one end portion, a concave container portion arranged at the other end portion, and a through-hole formed in the support portion so as to correspond to the wire insertion portion by penetrating from the one end portion to the other end portion side;

a lighting control device arranged in the concave container portion of the base body including a circuit board to mount electric parts constituting a lighting circuit for the light emitting element;

an insulating case arranged between the circuit board and the concave container portion of the base body including a protection element inserted in the through-hole of the base body and the wire insertion portion of the substrate so as to project at least to inside of the wire insertion portion;

a wire having one terminal connected to the lighting control device and the other terminal pulled out to the substrate side through the protection element; and a ferrule provided at the other end side of the base body and electrically connected with the lighting control device.

14. The lighting equipment according to claim 13, wherein the base body of the lamp is formed in a circular truncated cone shape having one end portion larger than the other end portion, and the through-hole formed in the base body and the wire insertion portion formed in the substrate are arranged so as to deviate from a central axis of the base body.

15. The lighting equipment according to claim 13, wherein the protection element of the lamp formed in the insulating case is arranged so as to project from the surface of the substrate.

16. The lighting equipment according to claim 14, wherein the lamp further comprises a cover element provided at the one end portion of the base body to cover the substrate, and the cover element, the base body and the ferrule provided at the other end portion of the base body form a whole appearance of a lamp approximated to a silhouette of a filament lamp (PS type).

17. The lighting equipment according to claim 16, the ferrule of the lamp includes a shell portion and an eyelet portion.

* * * * *